United States Patent [19]

Hull

[11] 3,949,795

[45] Apr. 13, 1976

[54] SINK CLIP INSERTING DEVICE

[76] Inventor: Donald G. Hull, Box 651, International Falls, Minn. 55649

[22] Filed: June 16, 1975

[21] Appl. No.: 586,904

[52] U.S. Cl. ..... 145/52; 29/259

[51] Int. Cl.[2] ..... B25B 15/00; B25B 23/08

[58] Field of Search ..... 29/259; 145/50 D, 50 E, 145/50 F, 52

[56] References Cited

UNITED STATES PATENTS

| | | | |
|---|---|---|---|
| 1,625,227 | 4/1927 | Staupe | 145/52 |
| 1,858,559 | 5/1932 | Richart | 145/52 |
| 2,040,713 | 5/1936 | Shaffer | 145/52 |

FOREIGN PATENTS OR APPLICATIONS

| | | | |
|---|---|---|---|
| 635,672 | 3/1962 | Italy | 145/52 |

*Primary Examiner*—James L. Jones, Jr.
*Attorney, Agent, or Firm*—Merchant, Gould, Smith, Edell, Welter & Schmidt

[57] ABSTRACT

A hand tool to facilitate installation of sink clips, comprising a frame coaxial with a screwdriver which is pivoted for rotation with respect to the frame and is urged toward the end of the frame remote from the screwdriver handle. A pair of jaws pivoted at the remote frame end, grip the sink clip in a position for the screwdriver blade to enter the slot of the attaching screw. The frame is used to install the clip and then held from rotating while the screwdriver secures the screw.

4 Claims, 3 Drawing Figures

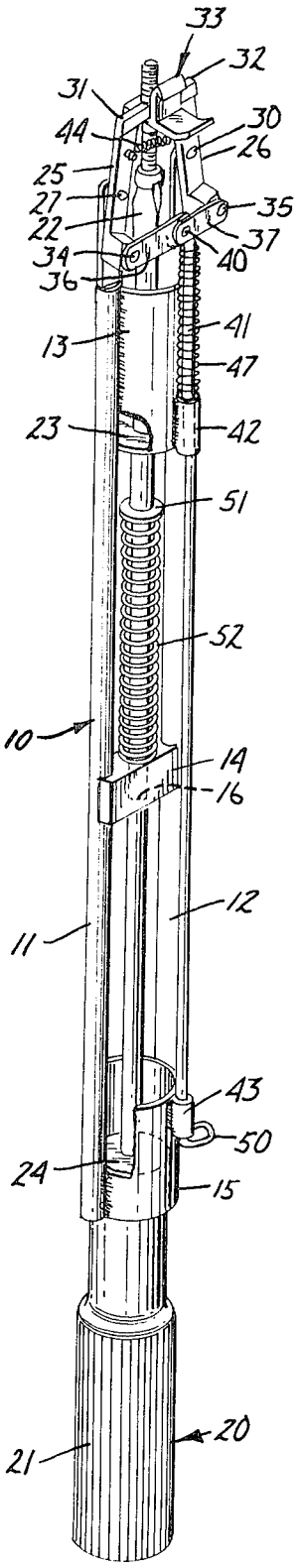
FIG. 1
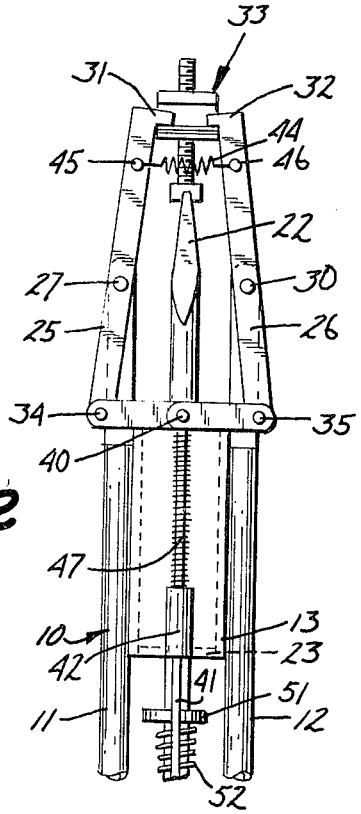
FIG. 2
FIG. 3
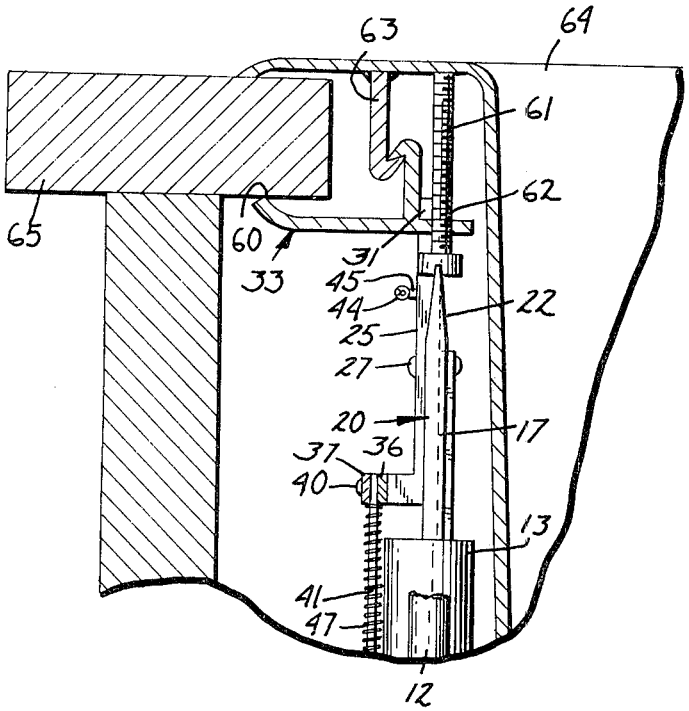

SINK CLIP INSERTING DEVICE

BACKGROUND OF THE INVENTION

This invention relates to the field of mechanics' hand tools, and comprises a device whereby the installation of sink clips is made more rapid and convenient.

In modern usage, sinks are usually installed in openings cut in the tops of built-in counters. The problem with securing the sink to the counter is solved by providing the sink with anchors at points spaced around its periphery, to cooperate with sink clips having hooks to engage the clip anchors of the sink, arms to engage the undersurface of the counter, and tapped holes to pass a screw which, when tightened, so that its tips bears against the undersurface of the sink rim, pivots the clip about the anchor to exert securing pressure against the counter.

While this arrangement is satisfactory from the point of view of functionality, it presents certain problems to the technician who is called upon to install the sink. The problems center around the matter of access. Kitchen design includes under-counter cabinets, and usual results in the location of cabinets, on each side of the sink, in such close proximity thereto that there is little space for the workman's hands to operate, so that holding the clip in position while tightening the screw is often very inconvenient, and consumes time out of all proportion to the apparent simplicity of the task.

SUMMARY OF THE INVENTION

My invention comprises a simple tool which holds a sink clip with a screwdriver tip in its screw slot. The tool is of sufficient length to extend below the sink bottom, so that the mechanic's hands have space to operate, yet the clip and screw are releasably held in a secure manner, and the clip is conveniently positioned and held against rotation while the screw is being tightened.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawings,

FIG. 1 is a perspective view of my tool with a sink clip received therein, ready to be installed;

FIG. 2 is a detailed view of the gripping end of the tool; and

FIG. 3 shows the installation of a clip being completed, using my improved tool.

DESCRIPTION OF THE PREFERRED EMBODIMENT

My tool comprises a frame 10 having longitudinal members 11 and 12, spaced by cross members 13, 14 and 15 secured thereto as by welding. Terminal cross members 13 and 15 are of hollow cylindrical configuration, while intermediate cross member 14 is solid except for a central aperture 16 to pass the shank 17 of a screwdriver 20, having a handle 21 at one end and a blade 22 at the other end. The screwdriver is maintained coaxial with the frame by aperture 16 in cross member 14 and by a pair of apertured disks 23 and 24 in terminal cross members 13 and 15 respectively.

Gripping means 25 and 26 are centrally pivoted to members 11 and 12 at their ends remote from handle 21, by pins 27 and 30, and include jaws 31 and 32 suitably configured to hold a sink clip 33 with its screw hole positioned in alignment with the frame axis and that of the screwdriver. At their ends remote from jaws 31 and 32, members 25 and 26 are enlarged and are pivoted at 34 and 35 to a pair of links 36 and 37, which are in turn pivoted at 40 to each other and to the end of a pull rod 41 extending through guides 42 and 43 carried on the outsides of cross members 13 and 14 respectively. A tension spring 44 connected to pins 45 and 46 urges jaws 31 and 32 together, and a compression spring 47 is mounted on rod 41 to urge it in the direction away from handle 21. The end of rod 41 nearest handle 21 is formed with a loop or eye 50: by pulling on eye 50, jaws 31 and 32 may be opened against the action of springs 44 and 47.

A disk 51 is secured to shank 17 of the screwdriver, as by welding, and a compression spring 52 acts between disk 51 and cross member 14 to urge the screwdriver toward gripping means 24 and 25.

In use, the jaws 31 and 32 are opened, by finger pressure on loop 50, and a sink clip 33 with a screw 61 inserted through its mounting hole 62 is placed between the jaws, screwdriver tip 22 being depressed axially to permit this. The jaws are allowed to close on the clip, and the screwdriver tip is oriented to enter the screw slot. When working from below, it is not difficult to position the clip, by manipulation of frame 10, so that it engages an anchor 63 of sink 64. By holding frame 10 motionless and rotating screwdriver 20 to tighten screw 61, clip 33 may be brought into engagement at 60 with the undersurface of counter 65. When the clip is tight, jaws 31 and 32 may be released by use of loop 50.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A mechanics' hand tool comprising in combination:

an elongated frame having a longitudinal axis and comprising opposite longitudinal members joined by intermediate and terminal cross members;

a screwdriver extending along the axis of said frame through and rotatable in said cross members and having a handle extending beyond said frame at one end thereof;

means including a compression spring continuously impelling said screwdriver toward an extreme position at the opposite end of said frame;

gripping means mounted on said frame at said opposite end thereof for closing toward said axis to hold an object such as a sink clip;

resilient means urging said gripping means into closed position; and means extending along said frame and operable from said one end thereof to open said gripping means.

2. Apparatus according to claim 1, in which terminal members are hollow cylinders.

3. Apparatus according to claim 1, in which said gripping means comprises a pair of jawed arms centrally pivoted at the ends of said longitudinal members, a tension spring urging said jaws into gripping position, a pair of links pivoted to each other and to the ends of said arms remote from the jaws, a pull rod connected to the common pivot of said links and extending toward said one end of said frame for linear displacement to open said jaws against the action of said tension spring, and spring means normally urging said pull rod toward said other end of said frame.

4. Apparatus according to claim 1, in which the gripping means act along a line intersecting the axis of the frame, while the links pivot in a plane substantially tangent to said terminal cylinders.

* * * * *